US009177738B2

(12) United States Patent
Park et al.

(10) Patent No.: US 9,177,738 B2
(45) Date of Patent: Nov. 3, 2015

(54) MOBILE TERMINAL

(71) Applicant: LG ELECTRONICS INC., Seoul (KR)

(72) Inventors: Minho Park, Seoul (KR); Hoseok Chung, Seoul (KR); Byungduck Park, Seoul (KR); Jongseok Park, Seoul (KR); Junyeop Jeong, Seoul (KR); Younji Shin, Seoul (KR)

(73) Assignee: LG Electronics Inc., Seoul (KR)

( * ) Notice: Subject to any disclaimer, the term of this patent is extended or adjusted under 35 U.S.C. 154(b) by 298 days.

(21) Appl. No.: 13/899,330

(22) Filed: May 21, 2013

(65) Prior Publication Data

US 2014/0027256 A1 Jan. 30, 2014

(30) Foreign Application Priority Data

Jul. 25, 2012 (KR) ..... 10-2012-0081424

(51) Int. Cl.
*H01H 13/702* (2006.01)
*H01H 13/7057* (2006.01)

(52) U.S. Cl.
CPC ..... *H01H 13/7057* (2013.01); *H01H 2203/038* (2013.01); *H01H 2205/004* (2013.01); *H01H 2219/064* (2013.01); *H01H 2221/074* (2013.01)

(58) Field of Classification Search
CPC .... H01H 13/70; H01H 13/72; H01H 13/7057
USPC ..... 200/5 A, 5 R, 341–345, 292, 512–517, 200/310–317
See application file for complete search history.

(56) References Cited

U.S. PATENT DOCUMENTS

| | | | | |
|---|---|---|---|---|
| 6,911,608 | B2 * | 6/2005 | Levy | 200/5 A |
| 7,217,898 | B2 * | 5/2007 | Chien et al. | 200/339 |
| 8,207,464 | B2 * | 6/2012 | Matsumoto et al. | 200/341 |

* cited by examiner

*Primary Examiner* — Amy Cohen Johnson
*Assistant Examiner* — Marina Fishman
(74) *Attorney, Agent, or Firm* — Birch, Stewart, Kolasch & Birch, LLP

(57) ABSTRACT

A mobile terminal having a terminal body, a circuit board located in the terminal body, the circuit board including a plurality of switches located thereon and an input device is provided. The input device is configured to input a control command and is installed at the terminal body. The input device includes a key top configured to be pressable in one direction, the key top having a rear surface facing the circuit board, a plurality of pressing portions protruding from the rear surface of the key top, each pressing portion being configured to extend toward a corresponding switch of the plurality of switches and at least one dummy pressing portion disposed between one pressing portion and another pressing portion of the plurality of pressing portions, the at least one dummy pressing portion being supported by the circuit board when the key top is pressed such that, when one switch of the plurality of switches is pressed by said one pressing portion, the at least one dummy pressing portion is configured to prevent said another pressing portion from pressing another switch of the plurality of switches.

13 Claims, 6 Drawing Sheets

MOBILE TERMINAL

CROSS-REFERENCE TO RELATED APPLICATIONS

Pursuant to 35 U.S.C. §119(a), this application claims the benefit of earlier filing date and right of priority to Korean Application No. 10-2012-0081424, filed on Jul. 25, 2012, the contents of which is incorporated by reference herein in its entirety.

BACKGROUND OF THE INVENTION

1. Field of the Invention

The present disclosure relates to a mobile terminal, and particularly, to a mobile terminal having an input device.

2. Description of Related Art

A mobile terminal is a device that can be carried around and has one or more functions such as to perform voice and video call communications, inputting and outputting information, storing data, and the like.

As functions of the terminal become more diversified, the terminal can support more complicated functions such as writing memos, receiving and transmitting e-mails and managing schedules. By comprehensively and collectively implementing such functions, the mobile terminal may be embodied in the form of a multimedia player or a device.

In order to execute such various functions and to perform input of information, the mobile terminal is provided with an input device. Such input device is implemented in various forms, e.g., a dome switch, a touch pad, a touch screen, a jog wheel and so on.

The input device implemented as a dome switch is configured to input information in a pressing manner, which is applied to a QWERTY-type keypad, a home key, a side key for volume control, etc. In case of an input device configured to generate different control commands according to a pressed position of a key such as a side key, not only a desired switch but also a neighboring switch may be pressed to cause a malfunction. In order to solve such problem, improving a structural part of the input device should be considered.

BRIEF SUMMARY OF THE INVENTION

Therefore, an aspect of the detailed description is to provide a mobile terminal capable of inputting information in a more precise manner, with a structure for preventing a malfunction, in an input device configured to generate different control commands according to a pressed position.

To achieve these and other advantages and in accordance with the purpose of this specification, as embodied and broadly described herein, there is provided a mobile terminal, comprising: a terminal body having a circuit board where a plurality of switches are installed; and an input device installed at the terminal body, and configured to input a control command, wherein the input device includes a key top installed to be pressable in one direction; a plurality of pressing portions protruding from a rear surface of the key top, arranged to correspond to the switches respectively, and configured to press the switches; and at least one dummy pressing portion disposed between one pressing portion and another pressing portion of the plurality of pressing portions, supported by the circuit board when one of the switches is pressed by said one pressing portion, and configured to prevent a malfunction resulting from that another switch is pressed when one of the plurality of switches is pressed.

According to an embodiment of the present invention, if said one switch is pressed by said one pressing portion, the dummy pressing portion may press the circuit board, and the key top may be elastically transformed.

According to another embodiment of the present invention, if said one pressing portion moves toward one direction as a point on the key top is pressed, said another pressing portion may be more restricted from moving than said one pressing portion, or may move toward another direction, by the dummy pressing portion.

According to another embodiment of the present invention, the dummy pressing portion may be formed to more protrude, toward the circuit board, than the plurality of pressing portions.

According to another embodiment of the present invention, the dummy pressing portion may be configured to maintain a contacted state with the circuit board.

According to another embodiment of the present invention, the dummy pressing portion may be formed of an elastically-transformable material.

According to another embodiment of the present invention, the dummy pressing portion may be formed of a different material from the key top, and may be integrally formed with the key top by insert injection molding.

According to another embodiment of the present invention, the plurality of pressing portions may include first and second actuators spaced from each other, and a third actuator disposed between the first and second actuators. The plurality of switches may include first to third switches disposed in correspondence to the first to third actuators, respectively. The dummy pressing portions may include a first dummy actuator disposed between the first and third actuators, and a second dummy actuator disposed between the second and third actuators.

In order to provide a differentiated key feeling when part of the key top corresponding to the third actuator is pressed, an interval between the third actuator and the third switch may be greater than an interval between the first actuator and the first switch, and an interval between the second actuator and the second switch.

The plurality of switches may be implemented as domes protruding toward the plurality of pressing portions, and the ends of the first and second actuators may be inclined such that the first and second switches are prevented from being pressed together when the third switch is pressed by the third actuator.

When at least two of the plurality of pressing portions are pressed within a prescribed time, may be generated a signal corresponding to a control command applied when the third switch is pressed.

A sound volume may be controlled when the first or second switch is pressed, and a sound volume may be made to be mute when the third switch is pressed.

Part of the key top corresponding to the third actuator, may be more recessed or protruding than parts of the key top corresponding to the first and second actuators.

The input device may further include a sheet formed of a different material from the key top, and disposed to cover a rear surface of the key top. The plurality of pressing portions and dummy pressing portions may be integrally formed with the sheet.

The sheet may include first and second sheet portions having the first and second actuators, respectively, such that the plurality of pressing portions operate independently from each other; and a third sheet portion disposed between the first and second sheet portions in a separated manner, and having the third actuator and the first and second dummy actuators.

The plurality of pressing portions may be provided with first and second actuators spaced from each other. The plurality of switches may include first and second switches installed on one surface of the circuit board facing the first and second actuators, and disposed to correspond to the first and second actuators, respectively; and a third switch installed on another surface of the circuit board so as to face a supporting member, and configured to be pressed by the supporting member when the circuit board moves toward the supporting member by press of the first and second dummy actuators.

According to another embodiment of the present invention, the input device may be provided on at least one side surface of the terminal body. The mobile terminal may further comprise a control board disposed in the terminal body, electrically connected to the circuit board, and configured to generate a signal corresponding to the control command; and a supporting member having a first supporting portion for supporting the control board, and a second supporting portion for supporting the circuit board, the second supporting portion formed in a direction perpendicular to the first supporting portion.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention. In the drawings.

DETAILED DESCRIPTION OF THE INVENTION

Hereinafter, a mobile terminal according to the present invention will be explained in more detail with reference to the attached drawings.

For the sake of brief description with reference to the drawings, the same or equivalent components will be provided with the same reference numbers, and description thereof will not be repeated. A singular expression includes a plural concept unless there is a contextually distinctive difference therebetween. The suffixes attached to components of the mobile terminal, such as 'module', 'unit' or 'portion' were used for facilitation of the detailed description of the present invention. Therefore, the suffixes do not have different meanings from each other.

The mobile terminal according to the present invention may include a portable phone, a smart phone, a laptop computer, a digital broadcasting terminal, Personal Digital Assistants (PDA), Portable Multimedia Player (PMP), an E-book, a navigation system, etc.

However, it will be obvious to those skilled in the art that the present invention may be also applicable to a fixed terminal such as a digital TV and a desktop computer.

Figure 1A:
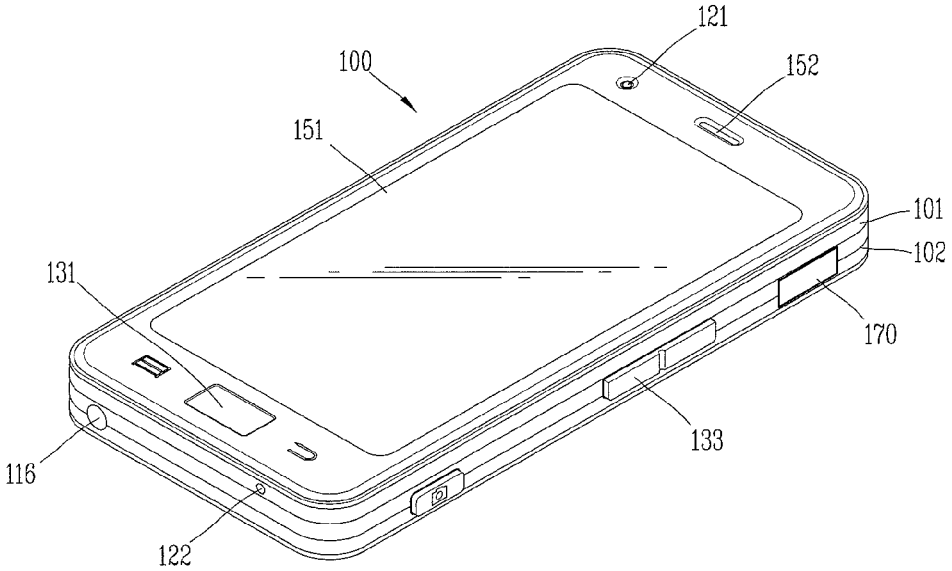
FIG. 1A is a front perspective view of a mobile terminal according to an embodiment of the present invention.

FIG. 1A is a front perspective view of a mobile terminal 100 according to the present invention.

Referring to FIG. 1, the mobile terminal 100 according to the present invention may include a first body 101 and a second body 102 coupled to each other so as to perform a relative motion with respect to each other. Various types of electronic components are mounted in a space formed by the first body 101 and the second body 102. While the mobile terminal 100 according to the present invention is a slide type mobile terminal in which the first body 101 and the second body 102 are coupled to each other so as to perform a relative motion with respect to each other, the present invention may be also applied to a bar type, a folder type, a swing type, etc.

The body includes a case (casing, housing, cover, frame, etc.) forming the appearance of the mobile terminal. In this embodiment, the second body 102 may be divided into a front case and a rear case. Various types of electronic components are mounted in a space defined by the front case and the rear case. At least one intermediate case may be disposed between the front case and the rear case.

Such cases may be formed by injection-molded synthetic resin, or may be formed using a metallic material such as stainless steel (STS), titanium (Ti) and aluminum (Al).

A display unit 151, a first camera 121, a first audio output unit 152, a first user unit 131, a microphone 122, etc. may be mounted to the first body 101. The display unit 151 may be disposed to occupy most parts of the first body 101. The first audio output unit 152 and the first camera 121 may be disposed at a region close to one end of the display unit 151, and the user input unit 131 and the microphone 122 may be disposed at a region close to another end of the display unit 151.

A second user input unit 132 (refer to FIG. 1C), a third user input unit 133, an interface unit 170, a power supply unit 190. etc. be mounted to the second body 102.

The first to third user input units 131, 132 and 133 are manipulated to receive a command for controlling the operation of the mobile terminal 100, and may be referred to as manipulating portions. The first to third user input units 131, 132 and 133 may include any type of ones that can be manipulated in a user's tactile manner using touch, push, scroll, etc.

In the present invention, the first user input unit 131 is implemented as a touch key. However, the present invention is not limited to this. For instance, the first user input unit 131 may be implemented as a mechanical key, or a combination of a touch key and a mechanical key.

The first and third manipulation units 132 and 133 may be set to receive inputs in various manners. For instance, the first manipulation unit 131 may be configured to input commands such as START, END, and SCROLL, and the third manipulation unit 133 may be configured to input commands such as controlling a volume of a sound outputted from the first audio output unit 152, or converting a mode of the display unit 151 into a touch recognition mode or a capturing mode, etc.

Figure 1B:
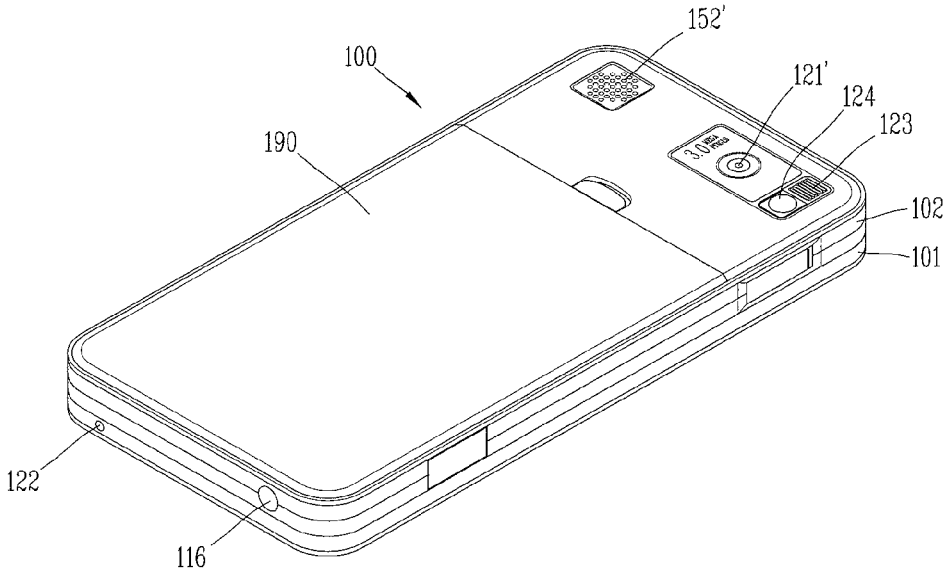
FIG. 1B is a rear perspective view of the mobile terminal of FIG. 1A.

FIG. 1B is a rear perspective view of the mobile terminal 100 of FIG. 1A.

Referring to FIG. 1B, a second camera 121' may be additionally mounted to the second body 102. The second camera 121' faces a direction which is opposite to a direction faced by the first camera 121 (refer to FIG. 1A), and may have pixels different from those of the first camera 121.

For example, the first camera 121 may operate with relatively lower pixels (lower resolution). Thus, the first camera 121 may be useful when a user can capture his or her face and send it to a calling party in a video call mode or the like. On the other hand, the second camera 121' may operate with a relatively higher pixels (higher resolution) such that it can be useful for a user to obtain higher quality pictures for later use. The first and second cameras 121 and 121' may be installed at the terminal body so as to be rotated or popped-up.

A flash 123 and a mirror 124 may be additionally disposed close to the second camera 121'. When capturing an object by using the second camera 121', the flash 123 provides light to the object. The mirror 124 can cooperate with the second camera 121' to allow a user to photograph himself or herself in a self-portrait mode.

A second audio output unit 152' may be additionally disposed on the rear surface of the second body 102. The second audio output module 152' may implement a stereo function together with the first audio output module 152 (refer to FIG. 1A), and may be used for calling in a speaker phone mode.

A broadcast signal receiving antenna 116, as well as an antenna for calling may be additionally disposed at the end of the second body 102. The broadcast signal receiving antenna 116, part of a broadcast receiving module may be installed to be retractable into the second body 102.

The power supply unit 190 for supplying power to the mobile terminal 100 is mounted to the second body 102. The power supply unit 190 may be mounted in the terminal body, or may be detachably mounted to the terminal body.

Figure 1C:
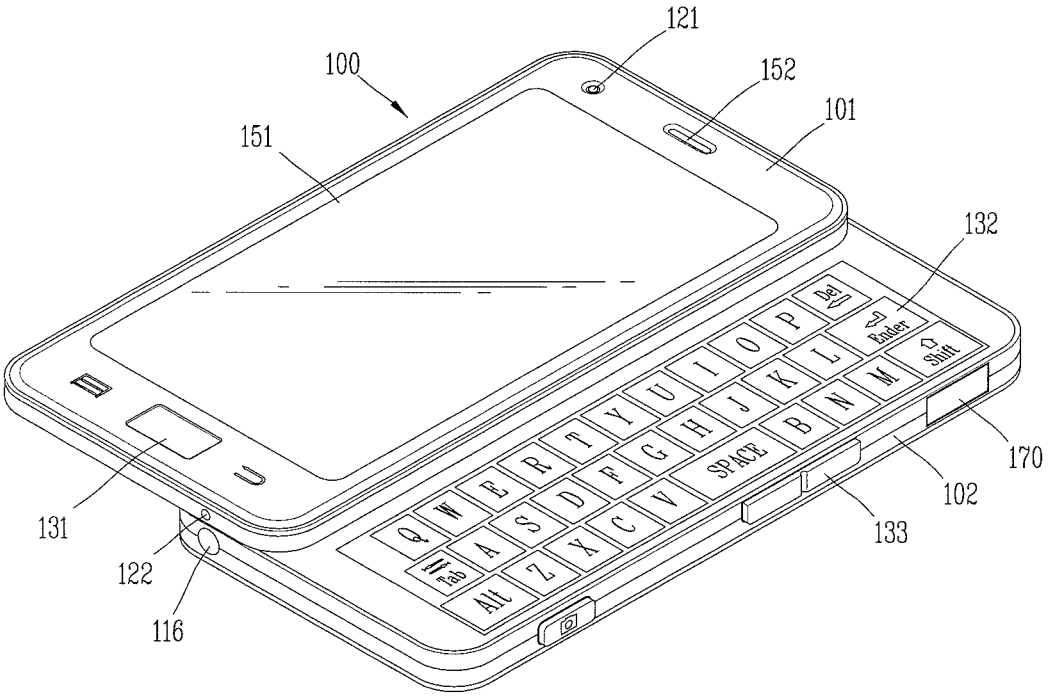
FIG. 1C is a perspective view showing an open state of the mobile terminal of FIG. 1A.

FIG. 1C is a perspective view showing an open state of the mobile terminal 100 of FIG. 1A.

The second body 102 may move, from a closed state where part thereof is blocked by the first body 101, to an open state where the blocked part is exposed to the outside. The second user input unit 132 is mounted to the exposed region of the second body 102.

The second user input unit 132 may include QWERTY type key buttons. Key information (e.g., characters, numbers, marks, etc.) for key input, is displayed on the key buttons. Such key information may be emphasized by a backlight.

The third user input unit 133 is disposed on the side surface of the second body 102. The third user input unit 133 may be configured to input commands such as controlling a volume of a sound outputted from the first audio output unit 152, or converting a mode of the display unit 151 into a touch recognition mode or a capturing mode, etc.

Hereinafter, will be explained a structure for preventing a malfunction in an input device capable of generating different control commands according to a pressed position.

Figure 2:
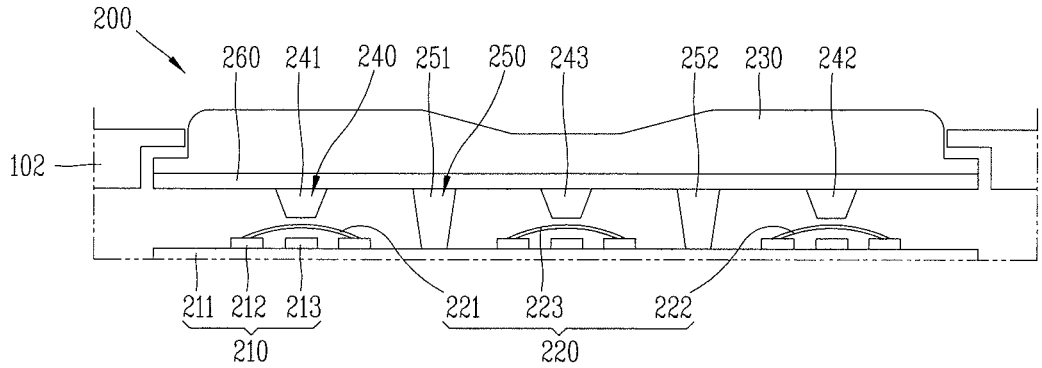
FIG. 2 is a sectional view of an input device of FIG. 1.
Figure 3A:
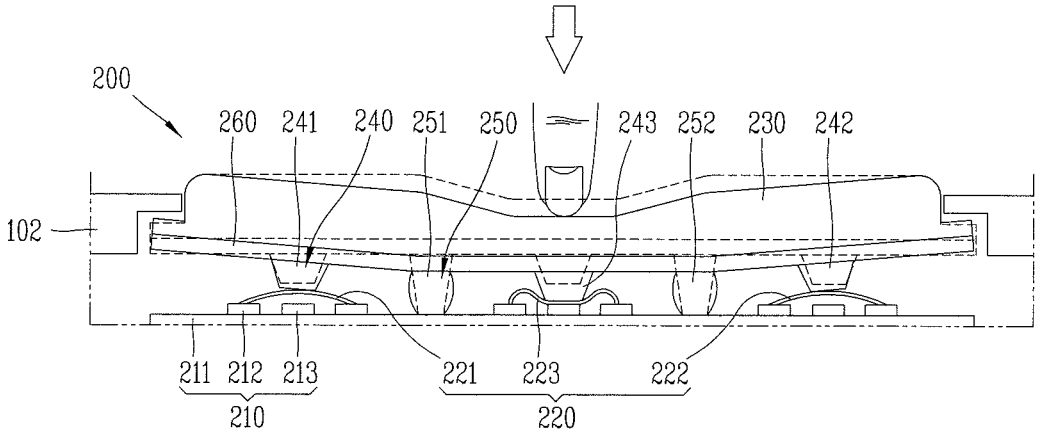
FIGS. 3A and 3B are conceptual views showing an operation state of the input device of FIG. 2.
Figure 3B:
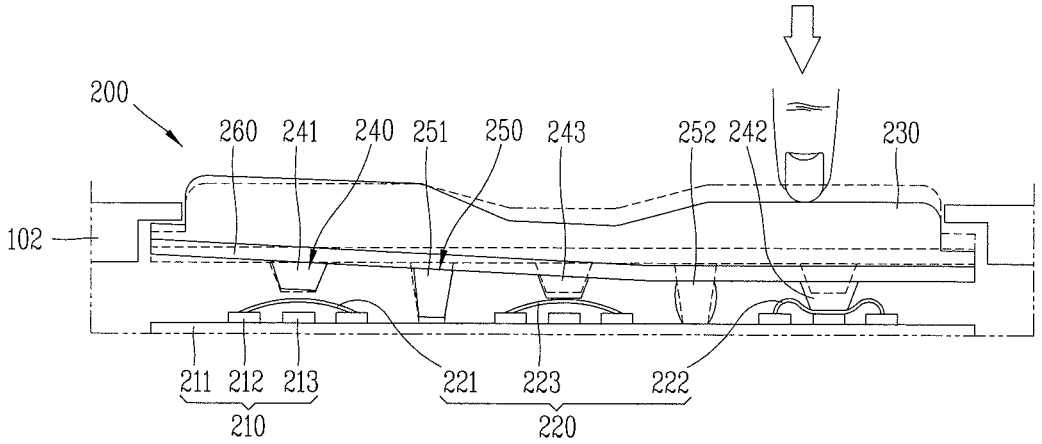

FIG. 2 is a sectional view of an input device of FIG. 1, and FIGS. 3A and 3B are conceptual views showing an operation state of the input device 200 of FIG. 2.

The input device 200 of the present invention is configured to input a control command to the mobile terminal 100 in a pressing manner. The input device 200 of the present invention may be applied to an input device including a dome switch, e.g., the third manipulation unit 133 disposed on a side surface of the second body 102 and configured to generate different control commands according to a pressed position.

Referring to FIG. 2, the terminal body is provided with a circuit board 210. The circuit board 210 may be implemented as an example of the controller for operating various types of functions of the mobile terminal 100. Alternatively, the circuit board 210 may be configured to be electrically connected to a control board 770 (refer to FIG. 8) which performs the above functions through a flexible printed circuit board (FPCB) 780 (refer to FIG. 8).

The circuit board 210 includes a base 211, a conductive layer 212 and a contact portion 213 each patterned on the base 211. The base 211 may be formed of an insulating material such as epoxy resin and bakelite resin, and may have a thin plate shape. The conductive layer 212 and the contact portion 213 spaced from the conductive layer 212 are printed on one surface of the base 211, thereby forming a circuit.

A plurality of switches 220 are installed on the circuit board 210. The switches 220 may have a dome shape, and may be formed to be elastically-transformable. The switches 220 are disposed on the conductive layer 212 so as to cover at least one contact portion 213, and are elastically-transformed by pressing to electrically connect the conductive layer 212 and the contact portions 213.

The plurality of switches 220 is configured to generate different control commands according to a pressed position of a key top 230. In this embodiment, the switches 220 include first to third switches 221, 222 and 223 disposed in correspondence to first to third actuators 241, 242 and 243, so that key inputs at two sides of the key top 230 can be distinguished from a key input at a central part of the key top 230.

The input device 200 includes the key top 230, a plurality of pressing portions 240 and a plurality of dummy pressing portions 250.

The key top 230 is installed at the terminal body so as to be pressed in one direction. The key top 230 may extend to cover the plurality of switches 220, in the arrangement direction of the switches 220. At least one of characters, numbers, marks, symbols, etc. may be printed on the key top 230.

The key top 230 may be formed of a material having a high strength. For instance, the key top 230 may be formed of polycarbonate (PC). For a higher strength, glass fiber or carbon fiber may be added to the key top 230. Under such configuration, bending does not occur even if any point of the key top 230 is pressed, resulting in a key input in a more precise manner.

The central part of the key top 230 may be more recessed or protruding than two sides of the key top 230, so as to be intuitively manipulated by a user. Under such configuration, a user may press the central part of the key top 230 in a precise and balanced manner. Further, in a case where the central part of the key top 230 protrudes, strength of the key top 230 can be more enhanced.

A plurality of pressing portions 240 protrude from the rear surface of the key top 230. The plurality of pressing portions 240 are disposed to correspond to the plurality of switches 220, respectively, thereby pressing the corresponding switches 220 when the key top 230 is pressed. In this embodiment, the pressing portions 240 include first and second actuators 241 and 242, and a third actuator 243 disposed between the first and second actuators 241 and 242.

The first actuator 241 or the second actuator 242 is configured to press the first switch 221 or the second switch 222 when one side of the key top 230 is pressed, and the third actuator 243 is configured to press the corresponding third switch 223 when a central part of the key top 230 is pressed. A sound volume may be controlled when the first switch 221 or the second switch 222 is pressed, and a sound volume may be made to be mute when the third switch 223 is pressed.

The pressing portions 240 may be formed of an elastically-transformable material such as urethane and silicone, and may be formed of a transparent material so that the key top 230 can be illuminated by a backlight. The pressing portions 240 may be integrally formed with the key top 230 by insert injection molding.

A dummy pressing portion 250 may protrude between two pressing portions among the plurality of pressing portions 240. The dummy pressing portion 250 is configured to prevent another neighboring switch 220 corresponding to another pressing portion 240 from being pressed, when one switch 220 corresponding to one pressing portion 240 is pressed, by being supported by the circuit board 210. In this embodiment, the dummy pressing portion 250 includes a first dummy actuator 251 disposed between the first and third actuators 241 and 243, and a second dummy actuator 252 disposed between the second and third actuators 242 and 243.

The dummy pressing portions 250 may be formed of an elastically-transformable material such as urethane and silicone. Unlike the pressing portions 240, the dummy pressing portions 250 may be formed of an opaque material so that the key top 230 cannot be illuminated by a backlight. The dummy pressing portions 250 may be integrally formed with the key top 230 by insert injection molding, together with the pressing portions 240. For instance, a sheet 260 having the plurality of pressing portions 240 and dummy pressing portions 250 may be attached to the rear surface of the key top 230.

The dummy pressing portions 250 may protrude, toward the circuit board 210, more than the pressing portions 240, and may maintain a contacted state with the circuit board 210. Under such configuration, some parts of the key top 230 may be always exposed to the outside, in a supported state by the dummy pressing portions 250. And the key top 230 may be configured not to be pressed, unless an external force more than a prescribed level is applied thereto.

Under such structure that the dummy pressing portions 250 are disposed between the pressing portions 240, the key top 230 performs a seesaw motion by having the dummy pressing portions 250 as its center. That is, the dummy pressing portions 250 play a role of a supporting plate of a seesaw. More specifically, if one pressing portion 240 moves toward one direction as a point on the key top 230 is pressed, another neighboring pressing portion 240 is more restricted from moving than said one pressing portion 240, or moves toward another direction, by the dummy pressing portions 250 supported by the circuit board 210.

When one switch 220 is pressed by one pressing portion 240, the dummy pressing portions 250 press the circuit board 210, and the key top 230 is elastically transformed to some degree. The degree of elastic transformation may not be recognized by a user's naked eyes, but was shown in a little exaggerated manner in FIGS. 3A and 3B for understanding.

More specifically, as shown in FIG. 3A, once a user presses a central part of the key top 230, the third actuator 243 moves in the pressing direction to thus press the third switch 223. The first and second dummy actuators 251 and 252, which are disposed at two sides of the third actuator 243, press the circuit board 210. The two sides of the key top 230 move in another direction by having the first and second dummy actuators 251 and 252 as the center of a seesaw, or are more restricted from moving than the center of the key top 230. In drawings, the first and second actuators 241 and 242 move together with the third actuator 243, but do not press the first and second switches 221 and 222 due to a relatively short moving distance thereof.

As shown in FIG. 3B, once a user presses one side of the key top 230 (part corresponding to the second actuator 242 in drawings), the second actuator 242 moves in the pressing direction to thus press the second switch 222. The second dummy actuator 252 adjacent to the second actuator 242 presses the circuit board 210. The central part and another side of the key top 230 move toward another direction by having the second dummy actuator 252 as the center of a seesaw, or are more restricted from moving than the center of the key top 230. More specifically, the third actuator 243 adjacent to the second actuator 242 moves enough not to press the corresponding third switch 223, and the first actuator 241 is spaced from the corresponding first switch 221 to thus be prevented from being clicked together.

Under such structure, in a case where the pressing portion 240 moves to press the corresponding switch 220, the dummy pressing portion 250 restricts movement of the neighboring pressing portion 240 by being supported by the circuit board 210. This can prevent a malfunction resulting from that the neighboring switch 220 is together pressed. That is, the switches can be clicked in an independent manner.

Even if multi clicks occur by a structural modification, the controller may recognize only one of the occurred multi clicks by a control aspect as well as a structural aspect. For instance, when at least two of the first to third actuators 241, 242 and 243 are pressed within a prescribed time, may be generated a signal corresponding to a control command applied when the third switch 223 is pressed. More specifically, in a case where at least two actuators are pressed, the controller recognizes that not only a desired central part of the key top 230, but also undesired neighboring parts have been pressed. In this case, the controller determines only the central part of the key top 230 to have been pressed.

FIGS. 4 to 8 are sectional views showing modification embodiments of the input device 200 of FIG. 2. The following input devices 300, 400, 500, 600 and 700 partially have the same structure as the aforementioned input device 200. Hereinafter, features of the input devices 300~700 differentiated from the input device 200 will be explained. The same or similar configurations as to those of the input device 200 will be provided with the same or similar reference numerals, and detailed explanations thereof will be omitted.

Figure 4:
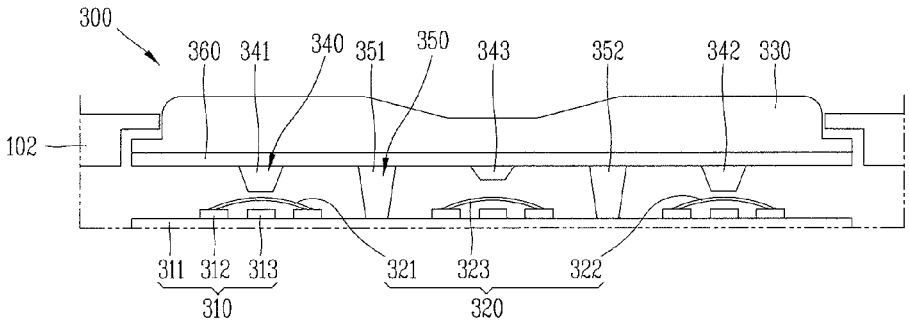
FIGS. 4 to 8 are sectional views showing modification embodiments of the input device of FIG. 2.

Referring to FIG. 4, an interval between a third actuator 343 and a third switch 323 may be greater than an interval between a first actuator 341 and a first switch 321, and an interval between a second actuator 342 and a second switch 322. Under such configuration, a differentiated key feeling can be provided when part of a key top 330 corresponding to the third actuator 343 is pressed.

More specifically, if the interval between the third actuator 343 and the third switch 323 increases, a greater force should be applied to press the central part of the key top 330, than in a case to press two sides of the key top 330. Under the aforementioned mechanism, the first and second actuators 341 and 342 are more spaced from the corresponding first and second switches 321 and 322, and move by a shorter distance than the third actuator 343.

Figure 5:
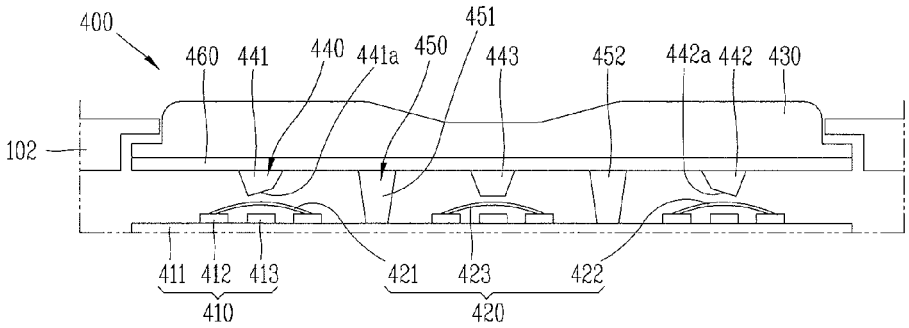

Referring to FIG. 5, a plurality of switches 420 are implemented as domes protruding toward a plurality of pressing portions 440. The ends 441*a* and 442*a* of first and second actuators 441 and 442 have an inclined shape that the inner side is shorter than the outer side, so that first and second switches 421 and 422 can be prevented from being pressed together when a third switch 423 is pressed by a third actuator 443. Under such configuration, even if the first actuator 441 or the second actuator 442 moves together with the third actuator 443, the end 441*a* or the end 442*a* does not press the corresponding first switch 421 or second switch 422. As a result, multi clicks can be prevented.

Figure 6:
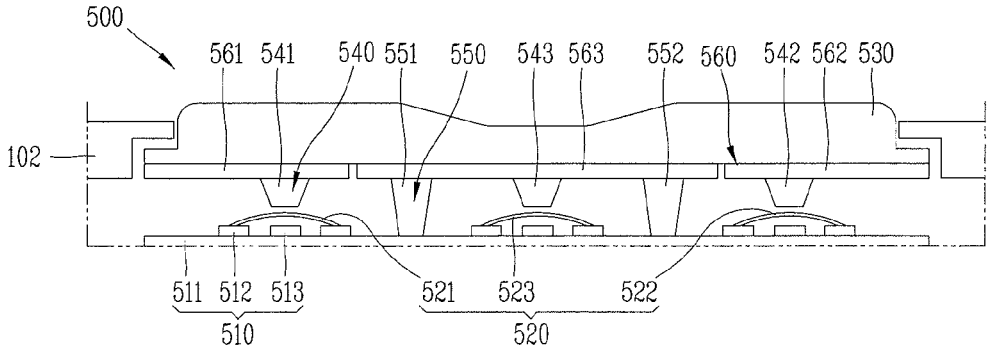

Referring to FIG. 6, as aforementioned, an input device 500 further includes a sheet 560 disposed to cover the rear surface of a key top 530. The sheet 560 may be formed of an elastically-transformable material such as silicone and urethane. A plurality of pressing portions 540 and dummy pressing portions 550 may be integrally formed with the sheet 560, and the sheet 560 may be integrally formed with the key top 530 by insert injection molding.

The sheet 560 may include first to third sheet portions 561, 562 and 563 separated from each other so that the plurality of pressing portions 540 can independently operate. The first and second sheet portions 561 and 562 are provided with first and second actuators 541 and 542, and are disposed at two sides of the key top 530. A third sheet portion 563 is disposed between the first and second sheet portions 561 and 562 in a separated manner therefrom, and is provided with a third actuator 543 and first and second dummy actuators 551 and 552.

Figure 7:
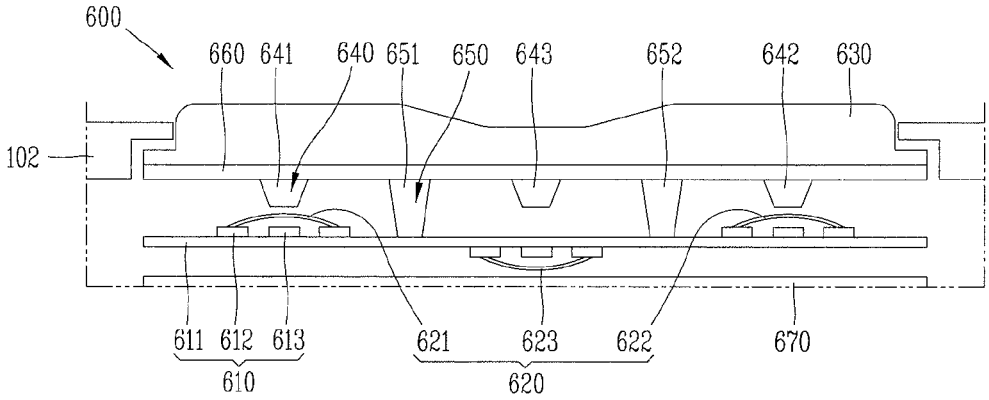

Referring to FIG. 7, a circuit board 610 is installed to face a supporting member 670, and is formed to be moveable toward a supporting member 670 by press of first and second dummy actuators 651 and 652. Unlike the structures of the aforementioned input devices 200, 300, 400 and 500, a third switch 623 may be installed on the rear surface of the circuit board 610, i.e., a facing surface to the supporting member 670.

Once a user presses a central part of a key top 630, the first and second dummy actuators 651 and 652 press the circuit board 610 to thus move the circuit board 610 toward the supporting member 670. The third switch 623 is pressed by the supporting member 670 to thus generate a signal. Under such configuration, the third switch 623 can be independently pressed, because it is installed on a different surface from first and second switches 621 and 622, and because it has a different pressing mechanism from the first and second switches 621 and 622.

Figure 8:
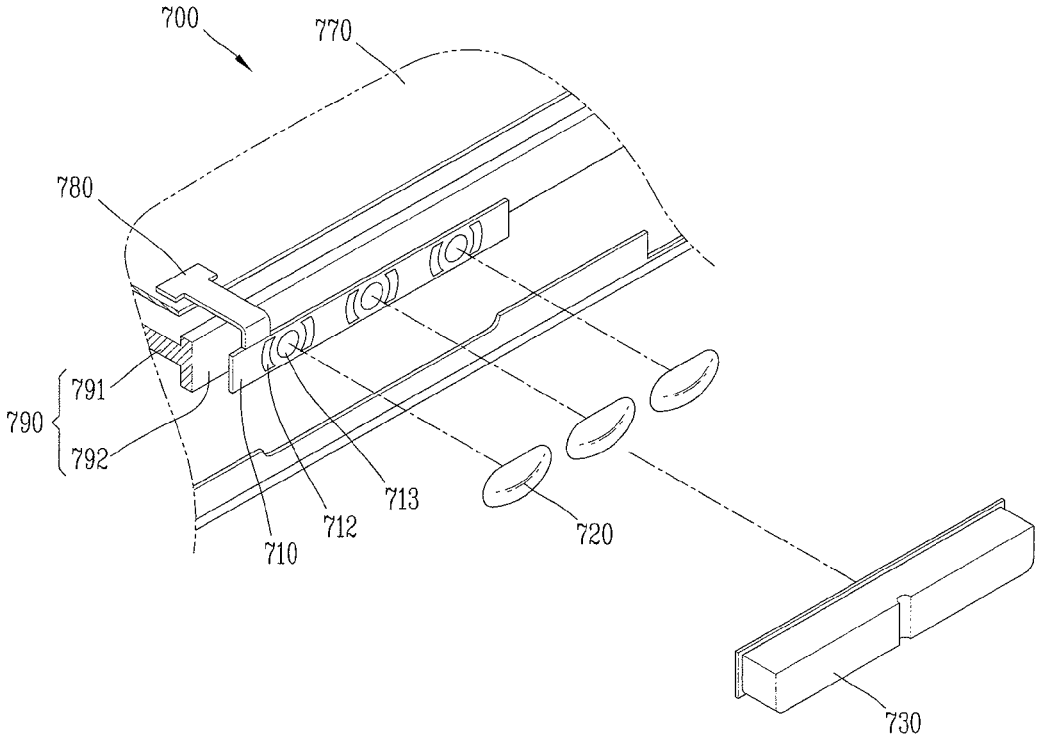

Referring to FIG. 8, an input device 700 may be configured as side keys disposed on at least one side surface of the terminal body. A control board 770 is disposed in the terminal body, and a circuit board 710 having a plurality of switches 720 may be electrically connected to the control board 770 through a flexible printed circuit board (FPCB) 780. The control board 770 and the circuit board 710 may be supported by a supporting member 790.

The supporting member 790 may include a first supporting portion 791 for supporting the control board 770, and a second supporting portion 792 for supporting the circuit board 710. The first and second supporting portions 791 and 792 may be formed to be perpendicular to each other. The circuit board 710 may be stably fixed to the second supporting portion 792 using an adhesion sheet or other structure.

The present invention can have the following advantages.

Firstly, when the pressing portion moves to press the corresponding switch, the dummy pressing portion restricts movement of the neighboring pressing portion by being supported by the circuit board. This can prevent a malfunction resulting from that the neighboring switch is together pressed.

Secondly, the shape of the key top, the interval between the third actuator and the third switch, and the shape of the first and second actuators can be controlled. Further, the sheet can have a separated structure. Under such configurations, can be implemented an input device capable of inputting information in a more precise manner.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A mobile terminal comprising:

a terminal body;

a circuit board located in the terminal body, the circuit board including a plurality of switches located thereon; and an input device located at the terminal body, the input device being configured to input a control command, the input device including:

a key top configured to be pressable in one direction, the key top having a rear surface facing the circuit board;

a plurality of pressing portions protruding from the rear surface of the key top, each pressing portion being configured to extend toward a corresponding switch of the plurality of switches; and at least one dummy pressing portion disposed between one pressing portion and another pressing portion of the plurality of pressing portions, the at least one dummy pressing portion being supported by the circuit board when the key top is pressed such that, when one switch of the plurality of switches is pressed by said one pressing portion, the at least one dummy pressing portion is configured to prevent said another pressing portion from pressing another switch of the plurality of switches, wherein the plurality of pressing portions includes first and second actuators spaced from each other, wherein the plurality of switches include first and second switches located on a first surface of the printed circuit board facing the first and second actuators, the first and second switches corresponding to the first and second actuators, respectively, and a third switch located on a second surface of the printed circuit board facing away from the first surface, wherein the terminal body includes a supporting member spaced from the circuit board, wherein the at least one dummy pressing portion includes a first dummy actuator disposed between the first and third switches and a second dummy actuator disposed between the second and third switches, and wherein the third switch is configured to be pressed by the supporting member when the circuit board moves toward the supporting member by displacement of the first and second dummy actuators.

2. The mobile terminal of claim 1, wherein, when said one switch is pressed by said one pressing portion, the at least one dummy pressing portion presses the circuit board, and the key top is elastically transformed.

3. The mobile terminal of claim 1, wherein, when said one pressing portion moves in a first direction when the key top is pressed, said another pressing portion is restricted in moving in the first direction or is moved in another direction because of the at least one dummy pressing portion being supported by the circuit board.

4. The mobile terminal of claim 1, wherein the at least one dummy pressing portion is formed to protrude further toward the circuit board than the plurality of pressing portions protrude toward the circuit board.

5. The mobile terminal of claim 1, wherein the at least one dummy pressing portion is configured to maintain a contacted state with the circuit board.

6. The mobile terminal of claim 1, wherein the at least one dummy pressing portion is formed of an elastically-transformable material.

7. The mobile terminal of claim 1, wherein the at least one dummy pressing portion is formed of a different material from the key top and is integrally formed with the key top by insert injection molding.

8. The mobile terminal of claim 1, wherein, when at least two of the plurality of pressing portions are pressed within a prescribed time, the input device is configured to generate a signal as if the third switch was pressed.

9. The mobile terminal of claim 1, wherein a sound volume is increased or decreased when the first or second switch is pressed and a sound volume is muted when the third switch is pressed.

10. The mobile terminal of claim 1, wherein a portion of the key top corresponding to the third switch is recessed or projected with respect to the portions of the key top corresponding to the first and second actuators.

11. The mobile terminal of claim 1, wherein the input device further includes a sheet formed of a different material from the key top, the sheet being disposed to cover the rear surface of the key top, and wherein the plurality of pressing portions and at least one dummy pressing portion are integrally formed with the sheet.

12. The mobile terminal of claim 1, wherein the input device is provided on at least one side surface of the terminal body.

13. The mobile terminal of claim 12, further comprising:

a control board disposed in the terminal body, the control board being electrically connected to the circuit board and configured to generate a signal corresponding to the control command, wherein the supporting member comprises a first supporting portion to support the control board and a second supporting portion to support the circuit board, the second supporting portion being formed in a direction perpendicular to the first supporting portion.

* * * * *